United States Patent [19]

Skala

[11] 4,364,336

[45] Dec. 21, 1982

[54] SELF STARTING OF INTERNAL COMBUSTION ENGINES BASED ON REACTOR

[76] Inventor: Stephen F. Skala, 3839 S. Wenonah Ave., Berwyn, Ill. 60402

[21] Appl. No.: 174,247

[22] Filed: Jul. 31, 1980

Related U.S. Application Data

[63] Continuation-in-part of Ser. No. 950,845, Oct. 12, 1978, abandoned, which is a continuation-in-part of Ser. No. 781,747, Mar. 28, 1979, abandoned, which is a continuation-in-part of Ser. No. 578,527, May 19, 1975, Pat. No. 4,020,798, which is a continuation-in-part of Ser. No. 464,454, Apr. 26, 1974, abandoned, which is a continuation-in-part of Ser. No. 457,207, Apr. 2, 1974, Pat. No. 3,911,284, which is a continuation-in-part of Ser. No. 301,285, Oct. 27, 1972, abandoned.

[51] Int. Cl.[3] ..... F02B 75/12

[52] U.S. Cl. ..... 123/1 A; 123/DIG. 12; 123/3

[58] Field of Search ..... 123/1 A, 25 E, DIG. 12, 123/3

[56] References Cited

U.S. PATENT DOCUMENTS

| | | | |
|---|---|---|---|
| 3,664,134 | 5/1972 | Seitz | 123/1 A |
| 3,696,795 | 10/1972 | Smith et al. | 123/1 A |
| 3,818,875 | 6/1974 | Phillips et al. | 123/1 A |
| 3,911,284 | 10/1975 | Skala | 290/16 |
| 4,020,798 | 5/1977 | Skala | 123/1 A |

*Primary Examiner*—Charles J. Myhre
*Assistant Examiner*—E. Rollins Cross
*Attorney, Agent, or Firm*—Stephen F. Skala

[57] ABSTRACT

Conventional reactants, such as hydrocarbons or hydrogen with air, which are used by most internal combustion engines have substantial activation energies which limit conditions under which the engines will start and operate. In a typical starting process, a separate starter motor turns the engine through several full cycles so that a compressed mixture of the reactants will ignite.

The invention includes reactants which have negligible activation energy, such as an alkali metal with water, and thus react upon contact to evolve a hot gas. An internal combustion engine is stopped in an expansion phase where it may remain for a time which is sufficient to approach equilibrium at ambient temperature and pressure in a combustion chamber. Starting comprises injecting the reactants in a contacting relationship into the combustion chamber which is stopped in an expansion phase whereby ignition must occur to rapidly evolve the hot gas and force the engine to advance. As the engine advances into phases of normal operation, the reactants having negligible activation energy are injected into a working fluid at optimal compression for efficient conversion to mechanical energy which is transmitted to a load.

The invention provides an assured starting transition to normal operation with simple apparatus and a low input of energy. The engine may stop whenever the accelerator is released for fuel economy during idling with assured restarting on demand.

13 Claims, 4 Drawing Figures

SELF STARTING OF INTERNAL COMBUSTION ENGINES BASED ON REACTOR

BACKGROUND

This application is a continuation-in-part of Ser. No. 301,285 filed Oct. 27, 1972 and now abandoned; and is a continuation-in-part of Ser. No. 457,207 filed Apr. 2, 1974 and now U.S. Pat. No. 3,911,284; and is a continuation-in-part of Ser. No. 464,454 filed Apr. 26, 1974 and now abandoned; and is a continuation-in-part of Ser. No. 578,527 filed May 19, 1975 and now U.S. Pat. No. 4,020,798; and is a continuation-in-part of Ser. No. 781,747 filed Mar. 28, 1977 and now abandoned; and is now a continuation-in-part of Ser. No. 950,845 filed Oct. 12, 1978 and now abandoned.

This engine relates to internal combustion engines based on injection of reactants having negligible activation energy and particularly to self starting of such engines.

The parent application Ser. No. 301,285 and U.S. Pat. No. 3,911,284 include a description of a free piston internal combustion engine into which a liquid alkali metal and water are injected to produce hot hydrogen which develops power as it expands against a piston. A characteristic of the alkali metal-water reaction is that it occurs spontaneously and instantly upon contact as a result of its negligible activation energy. The present invention uses this characteristic to provide a highly reliable and simple process for starting internal combustion engines which use such reactants as a fuel.

An idle engine having a combustion chamber at ambient pressure and temperature provides an environment for reaction similar to that studied and reported by M. Kilpatrick et al in "The Journal of Physical Chemistry", Vol. 59, 385 (1953) wherein liquid alkali metal and water were injected as colliding jets into a reactor of constant volume. When air is present, the reactions occur in two distinct steps. The first step represented by $$Na + H_2O \rightarrow \tfrac{1}{2}H_2 + NaOH$$

occurred spontaneously and was completed during the two millisecond injection interval which is characteristic of reactants having negligible activation energy. Other reactants which also react instantly and spontaneously upon contact with negligible activation energy include triethyldialane, $(C_2H_5)_3Al_2H_3$, with water to evolve hydrogen and sodium with bromine which does not evolve a gas.

The second step of the reaction of sodium with water in the presence of air $$\tfrac{1}{2}H_2 + \tfrac{1}{4}O_2 \rightarrow \tfrac{1}{2}H_2O$$

was delayed to occur as a second pressure transient which is characteristic of reactions involving substantial activation energy. Activation energy corresponds to an energy barrier representing intermediate reaction complexes between a higher initial and a lower final energy state. Conventional fuels having substantial activation energy such as liquid and gaseous hydrocarbons, hydrogen, alcohols, ammonia, and hydrazine reacting with oxygen all from metastable mixtures which require ignition in internal combustion engines to overcome activation energy barriers. The fuel-oxidant reaction process includes mixing the fuel vapor and oxidant, initiating the reaction by such means as a spark or a high temperature, an induction period during which intermediate active species such as peroxides and aldehydes which promote subsequent reactions but release negligible heat themselves accumulate to a critical concentration, and an ignition phase characterized by a rapid chain reaction with an accelerating increase of temperature and pressure to complete the reaction.

The substantial activation energy and consequent reaction process of conventional fuels constrains design of spark ignited Otto engines and compression temperature ignited Diesel engines. The Otto engine is enabled by the metastability of an explosive working fluid but other effects are undesirable. Detonation, which can occur during steady engine operation and is damaging and inefficient, is reduced by limiting compression below thermodynamically efficient limits, by use of more expensive high octane fuels, and by more complex ignition of rich mixtures in separate chambers. Operable fuel-air mixtures are maintained by throttling with consequent pumping loss. Starting at ambient engine temperatures requires inefficiently rich fuel-air mixtures to reduce ignition delay and requires cranking at least through a complete cycle to include intake and compression. Low temperature starting is difficult even with more volatile fuels and extended cranking. Large Diesel engines with open chambers operate efficiently at optimal compressions in the range of 11:1 to 18:1 with moderate surface heat loss but are subject to undesirable effects of activation energy which include detonation with consequent audible engine knock, engine stresses, and rough operation. Automotive Diesel engines having prechambers for initial partial combustion reduce detonation but the ignition and mixing process extends combustion to reduce thermodynamic efficiency and high compression ratios of over 20:1 required for ignition result in large heat loss through combustion chamber surfaces. Starting at ambient temperatures requires full compression to attain ignition temperatures with auxiliary glow plugs and occasional use of volatile fuel additives.

None of the prior internal combustion engines based on fuel and oxidant reactions having substantial activation energy have the desirable combination of simple open chamber structure, optimal compression with constant volume heat addition for thermodynamic efficiency, absence of detonation, and simple and reliable cold engine starting. Nor could the prior internal combustion engines be started by injecting fuel into the combustion chamber of a stopped engine. If the fuel injection occurred shortly after stopping, compressed air temperature would have dropped rapidly below fuel ignition temperature. After a longer but still brief period, any compressed air or other working fluid would have been lost through imperfect seals. Under such conditions of low temperature and pressure, no fuel having a substantial activation energy would ignite spontaneously and would provide negligible power even if it were ignited to react with residual working fluid by a spark or other means. Restarting of such engines even at operating temperatures requires cranking through at least a complete cycle and is not sufficiently reliable to allow engine shut off while slowing and idling. Yet urban driving includes substantial periods of idling to result in unnecessary use of fuel. It would, accordingly, be desirable to provide an engine having the feature of simple, economical, and reliable restarting after an idle period.

OBJECTS

It is a general object of the invention to provide improved self starting internal combustion engines which are fueled by reactants having negligible activation energy whereby reaction is spontaneous and instant upon contact of the reactants.

It is another object to provide methods and systems for simple and reliable restarting of such engines.

SUMMARY

These and other objects and advantages which will become apparent are accomplished in accordance with the invention wherein reactants having negligible activation energy and evolving a gas are injected in a contacting relationship into a combustion chamber which communicates with a movable member stopped in an expansion phase. The reaction which occurs spontaneously and instantly upon contact of the reactants is completed during a brief injection period to provide an impulse of hot evolved gas which propels the movable member through its expansion phase to impart sufficient momentum to restart the engine. In subsequent expansion phases after restarting, the reactants are injected into a working fluid at substantially maximum compression to result in a thermodynamic cycle which is similar to that of high compression Otto engines and larger Diesel engines.

The invention is embodied in various engine types and means for attaining the expansion phase which include:

a. a free piston engine in which a pair of pistons are normally forced toward each other and thus remain in an expansion phase for restarting, b. an engine which is cranked by a phase advancing motor into an expansion phase upon stopping and during an idle period where it remains until restarting.

c. an engine which has a sufficient plurality of movable members to assure that at least one is in an expansion phase for injection of the reactants, and d. an engine which is stopped in an expansion phase as it approaches idle where it remains until it is restarted.

These and other internal combustion engines based on injection of reactants having negligible activation energy and evolving a gas have the unique starting characteristics that entry into an expansion phase occurs substantially before the starting process whereby the engine is in a condition for rapid restarting, and substantially all starting power is provided by the hot evolved gas which is released spontaneously and instantly upon contact of the reactants.

Preferred reactants having negligible activation energy and evolving a gas are the liquid alkali metal NaK and water which react spontaneously and instantly upon contact to evolve hydrogen. It would be possible for the engines to operate with the evolved hydrogen as the sole working fluid as the example of the free piston engine demonstrates, but a more simple and economical system results when all available reaction energy is released during a single combustion period in a working fluid of air which is preferred. This single combustion period occurs when NaK and water are injected into air at maximum compression. The reaction consists of two steps having distinct characteristics which are the NaK-water reaction having negligible activation energy and the hydrogen-oxygen reaction which has substantial activation energy. The combustion differs from the combustions having substantial activation energies which occur in conventional internal combustion engines. About half of the available energy is released by the NaK-water reaction so that any undesirable activation energy effects of the hydrogen-oxygen reaction are reduced accordingly. But the hydrogen-oxygen reaction is improved since hydrogen forming along a path of reacting NaK and water as a hot gas in hot compressed air comprises a heterogeneous rich mixture which is locally ignited by the NaK-water functioning as a pilot fuel. Ignition of the hydrogen-oxygen is rapid without substantial accumulation of intermediate reaction products to preclude the ignition delay and detonation which are problems of conventional fuels. The expansion phase of an engine in normal operation after starting is characterized by two overlapping heat addition steps with the reaction of NaK and water occurring upon contact over an injection period of about two milliseconds and with the hydrogen reacting with oxygen under highly favorable conditions with minimal ignition delay. The heat release occurs over a brief period at substantially maximum compression. The compression can be optimal since excessive compression is not required to facilitate starting and insufficient compression is not required to avoid detonation. The reaction characteristics allow use of a simple open chamber structure for economy without sacrifice of performance or efficiency. Control of engine power by regulating fuel injection rather than by throttling further improves efficiency over Otto engines. Thus optimal compression, complete combustion, reduced heat loss through simple combustion chamber surfaces, low pumping loss, and a virtual elimination of idling loss through stopping and restarting the engine combine to provide a highly efficient engine.

The engine is environmentally benign since carbon dioxide and other organic gases are not formed and oxides of nitrogen tend to form salts which are collected with alkali hydroxide reaction products for reduction back to alkali metal.

DESCRIPTION OF THE DRAWINGS

Figure 1:
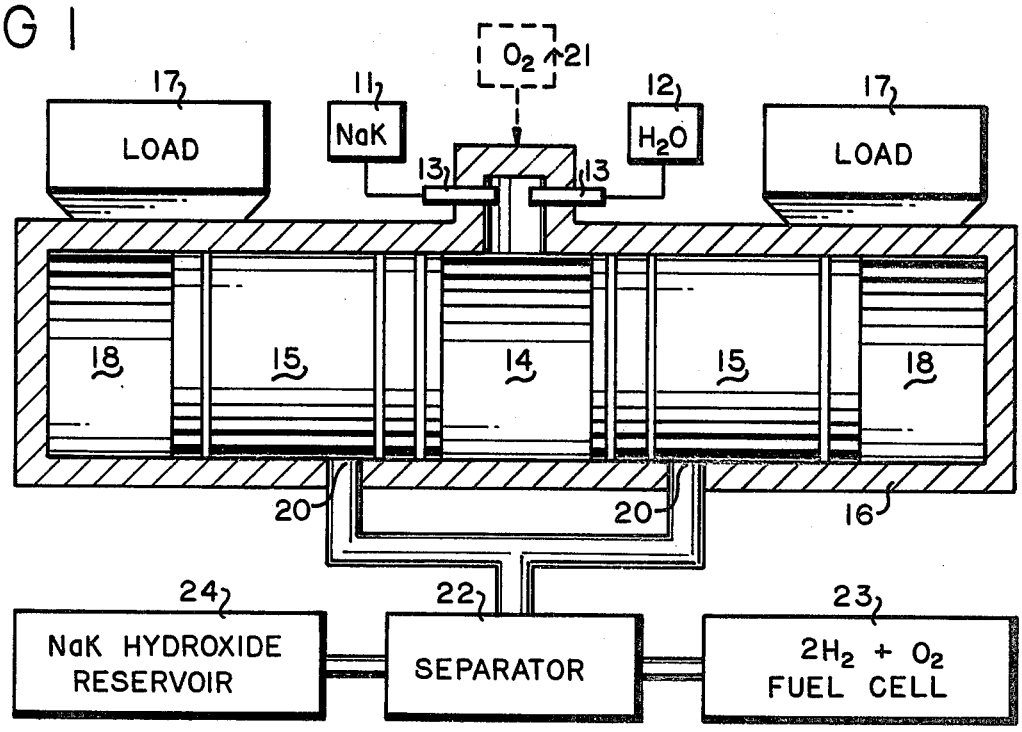
FIG. 1 is a diagrammatic drawing partly in section showing means for starting a free piston internal combustion engine by injection of reactants having negligible activation energy and evolving a gas into a combustion chamber communicating with a movable member which is in an expansion phase according to the invention.

FIG. 1 shows a free piston internal combustion engine using a reaction of NaK and water to form hot hydrogen which expands against a load to generate mechanical power which is converted to electrical power by the load. Hydrogen exhausted from the engine is transferred to a hydrogen-oxygen fuel cell for conversion to electrical power. The NaK is part of a fuel system cycle and the internal combustion engine is part of a hybrid vehicle having an electric motor drive, battery electrical storage, and electrical generators comprising the internal combustion motor-generator and the fuel cell as was described in the cited parent application and U.S. Pat. No. 3,911,284.

NaK from NaK reservoir 11 and water from water reservoir 12 are injected by reactant injectors 13 into combustion chamber 14 between a pair of reciprocating pistons 15. Hydrogen gas, formed and heated by the NaK and water reaction, forces the pistons toward opposite ends of cylinder 16. The outward motion of the pistons is restrained by a load 17 and by work of compressing air in end portions 18 of the cylinder. The load is a variable reluctance electrical generator coupled magnetically to the pistons. As the pistons approach their maximum end position, a sliding valve consisting of the piston and port 20 opens to exhaust the combustion chamber and to allow the force of air entrapped in the end portions of the cylinder to drive the pistons inward. As the pistons move inwardly to compress the hydrogen in the combustion chamber, the driving force of the air entrapped in the end portions of the cylinder decreases to become a restraining force while energy is transferred to the load. The energy transferred to the load is restored to the pistons by succeeding injections of NaK and water into the combustion chamber 14 to sustain oscillatory movement of the pistons. As an alternative practice, oxygen could be introduced into the combustion chamber 14 from compressed oxygen source 21 so that the hydrogen formed during the reaction of NaK with water would undergo combustion. Exhaust products comprising the hydrogen gas and particulates of NaK hydroxide passing through the exhaust port 20 enter separator 22 where the particulates are separated from the gas as is described in more detail in the cited copending application. The hydrogen is directed to fuel cell 23 for reaction with oxygen to generate electrical power and the NaK hydroxide is deposited in NaK hydroxide reservoir 24 for retention and removal during a fuel stop.

Although free piston engines have been operated as spark ignited and compression temperature ignited engines, it has been difficult to attain adequate compression and temperature for starting. The reactant contact ignited engine of the present invention, however, is easily started even under cold engine conditions. Representative initial conditions are ambient temperature and pressure in the combustion chamber 14 and end portions 18 of the cylinder. An initial injection of NaK and water generates hot hydrogen which expands to begin oscillatory motion of the pistons which increases with succeeding injections of NaK and water to normal amplitude.

Figure 2:
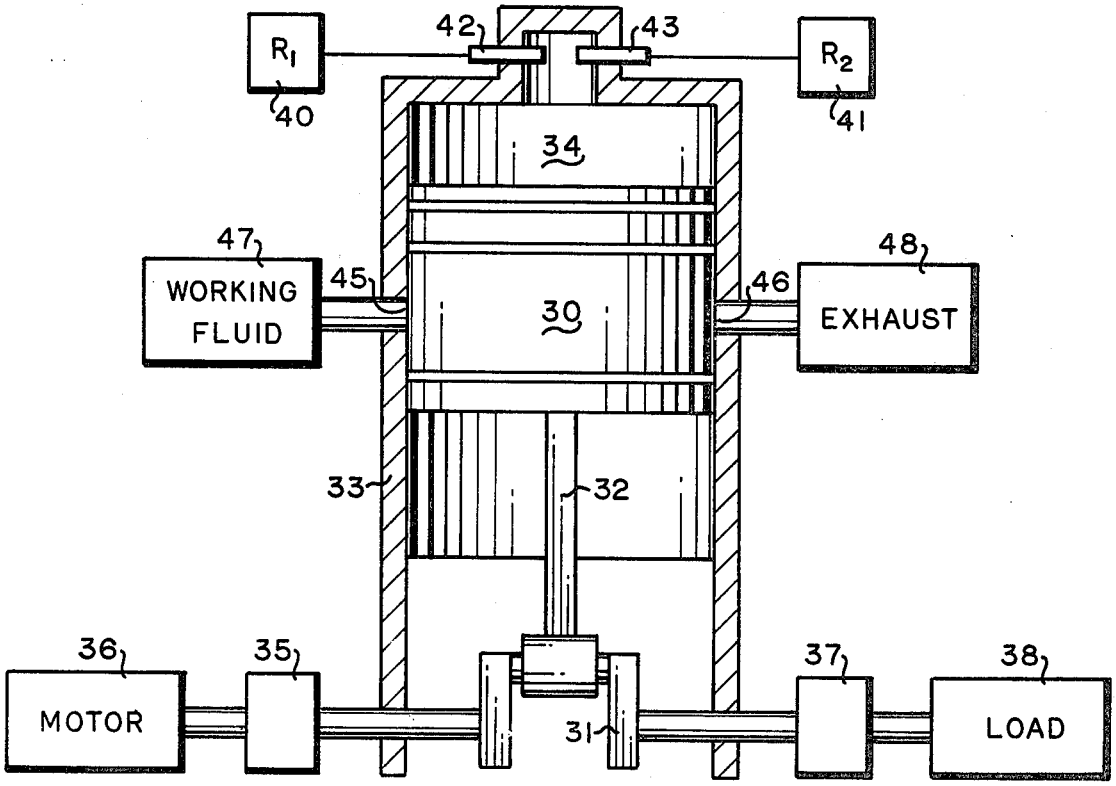
FIG. 2 is a diagrammatic drawing partly in section showing a two stroke cycle internal combustion engine having a phase advancing motor to position a piston in an expansion phase upon stopping for subsequent injection of said reactants for starting according to the invention.

FIG. 2 shows a two stroke cycle internal combustion engine which is advanced into an expansion phase during an idle period for starting by injection of reactants having negligible activation energy and evolving a gas.

A piston 30 connected to crank 31 through connecting rod 32 reciprocates within cylinder 33. A combustion chamber 34 includes upper portions of the cylinder and the piston. The crank connects through an engaging means 35 to a phase advancing motor 36 which may be an electric, air, or spring motor having sufficient capacity to advance the engine into an expansion phase. The crank 31 also connects through a clutch 37 to load 38 which may be a drive train of a vehicle, not shown.

When the piston passes through its maximum upward position to enter an expansion phase, a first reactant from a reservoir 40 and a second reactant from a reservoir 14 are injected through injectors 42 and 43 respectively as intersecting or colliding jets. The injectors may have the structure described in the cited paper by Kilpatrick et al. and may be operated by a mechanical pump or by valves synchronized with the crank 31 as is known for Diesel engine fuel injectors. As the piston 30 approaches its maximum downward position, it passes intake port 45 and exhaust port 46. A working fluid 47 under pressure enters the combustion chamber 34 while exhaust 48 comprising working fluid and products of reaction is processed for release to the atmosphere. During normal operation, the phase advancing motor is disconnected from the crank 31 and the load is connected through the clutch 37. At the downward position of the piston, the scavenging working fluid 47 displaces spent working fluid exhaust 48 and a compression stroke begins. At substantially the maximum upward position of the piston, the reactants are injected into the combustion chamber containing the working fluid under substantially maximum compression with injection timing adjusted to advance at high engine speed and to retard at low speed for improved efficiency.

When the engine is to be stopped, injection of the reactants is stopped, the load is disconnected, and the phase advancing motor 36 is engaged to the crank. The phase advancing motor turns the crank until the piston 30 is just past its maximum upward position in response to a crank angle sensing means, not shown. The phase advancing motor is then disengaged from the crank prior to restarting.

Restarting of the engine, which is stationary in an expansion phase, occurs upon injection of the reactants whereby the heated evolved gas functions as a working fluid to drive the piston downward with sufficient velocity for angular momentum of the crank 31 and associated flywheel, not shown, to propel the piston into the next expansion phase. The reactants are then injected into the working fluid at maximum compression and the load is connected for normal operation. In engines having injector actuating means which are synchronized with engine phase electrically, injection for restarting occurs upon a start signal. In engines having injector actuators coupled mechanically to synchronize with engine phase angles, injection occurs either upon advancing injector timing or upon incrementally advancing the engine by means of the phase advancing motor 36 which is momentarily connected to the crank. The embodiment wherein the injectors are actuated by an incremental advance of the engine by several degrees to initiate starting has no substantial effect on pressure, temperature or other conditions of the combustion chamber.

Engine starting which includes advancing the engine into an expansion phase during an idle period after stopping for subsequent injection of the reactants has advantages over conventional starting systems and processes which include:

slower cranking speed at low power to enable use of a small and economical phase advancing motor and associated assemblies, smaller battery capacity since restarting requires only the small energy to turn the engine through less than one cycle, and a more rapid assured restarting to allow engine shut off during idling for improved fuel economy.

Figure 3:
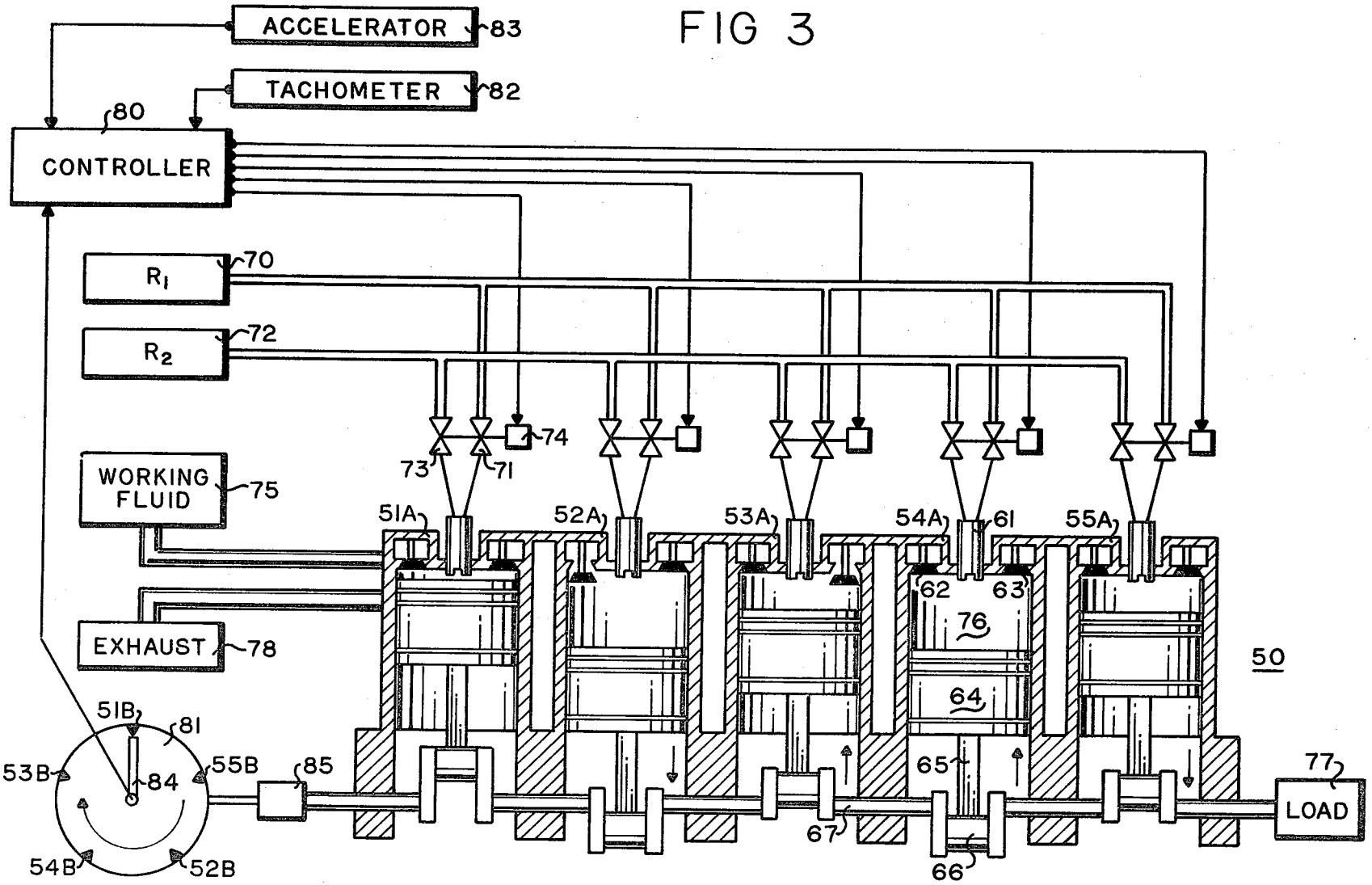
FIG. 3 is a diagrammatic drawing partly in section showing a four stroke five cylinder internal combustion engine whereby at least one of the cylinders is in an expansion phase and is selected for injection of said reactants to provide energy for starting according to the invention.

FIG. 3 illustrates an alternative process for starting and operating an internal combustion engine which derives power from the spontaneous and instant reaction of reactants which evolve gases such as the preferred reaction of NaK with water to evolve hydrogen. In an internal combustion engine having a sufficient plurality of cylinders to assure that at least one of the cylinders is in an expansion phase, the reactants are injected into the cylinder in an expansion phase to evolve hot gases which expand to provide power for starting and operation. The engine shown is of a four stroke cycle type having five cylinders.

Engine block 50 comprises five similar cylinder assemblies designated 51A, 52A, 53A, 54A, and 55A each having an injector such as 61 for injecting a first and a second reactant in a contacting and mixing relation, an intake valve such as 62, an exhaust valve such as 63, a piston such as 64, a connecting rod such as 65, and a crank bearing such as 66. The crank bearings 66 connect to a crank shaft 67. The crank shaft is linked by conventional means, not shown, to a cam assembly, also not shown, which opens and closes the intake valves and the exhaust valves at appropriate phases. A first reactant reservoir 70 provides the first reactant, such as NaK, under pressure to first reactant valves such as 71. A second reactant reservoir 72 provides the second reactant, such as water, under pressure to second reactant valves such as 73. For each cylinder, the first and second reactant valves are controlled to operate together by a solenoid such as 74. During normal operation after the engine has started, a working fluid such as air from working fluid intake 75 flows past an open intake valve into a cylinder in an intake phase, shown as 52A, and is compressed in a cylinder in a compression phase, shown as 54 A. The first and the second reactant valves 71 and 73 are opened together by solenoid 74 for injection of the first and the second reactant into a cylinder combustion chamber such as 76 to coincide with maximum compression of the working fluid. Reaction heat and evolved gases added to the working fluid force the piston to turn the crank against load 77. During an exhaust phase, shown as 53A, the working fluid now including products of reaction of the first and the second reactants and of the evolved gases is forced past an open exhaust valve into exhaust system 78. The exhaust system removes particulate reaction products from the gaseous portion of the working fluid which is released to the atmosphere as is described in more detail in my U.S. Pat. No. 4,189,916.

Starting of a stationary engine is attained by selecting injection of the first and second reactants into a cylinder in an expansion phase. In reciprocating engines, the crank angle must be sufficient to result in a substantial component of force normal to the crank radius to generate a torque on the crank. A piston at top or bottom center, for example, would not generate such a torque. Crank angles and phases shown in the drawing are: cylinder 51A is at 0° at top center just entering an expansion phase, cylinder 55A is at 72° in an expansion phase, cylinder 52A is at 144° in an intake phase, cylinder 54A is at 216° in a compression phase, and cylinder 53A is at 288° in an exhaust phase. Selection of a cylinder for injection of the first and second reactants is determined by controller 80 in response to crank angle information from distributor 81, to engine rotation speed information from tachometer 82, and to driver demand information from accelerator 83. The distributor has a rotor 84 which is connected to the crank through gear reducer 85 which gear reducer provides a 2:1 division for four stroke cycle engines which have one power stroke for every two revolutions of the crank. Alignment of the rotor 85 with sensors 51B through 55B generates a signal for the controller indicating the beginning of an expansion stroke in corresponding cylinders 51A through 55A. When the accelerator input corresponds to driver demand for start and operate, when the rotor and crank positions are as shown in the drawing, and when the tachometer input corresponds to zero RPM, the controller rejects injection of reactants into cylinder 51A entering an expansion phase since starting torque is not generated and instead causes injection of the first and second reactants into cylinder 55A which is substantially into an expansion phase and has a substantial component of force normal to a crank radius. Evolved hot gases drive the piston downward to begin crank rotation. As the controller senses further entry of cylinder 51A into an expansion phase, it causes injection of the first and second reactants into cylinder 51A to contribute to starting power. As the crank continues to rotate, a partial charge of working fluid initially present in cylinder 54A is compressed and the first and second reactants are injected at top center with evolution of hot gases which react with the working fluid as, for example, evolved hydrogen reacting with atmospheric oxygen. Further rotation of the crank compresses a full charge of working fluid in cylinder 52A for injection of the first and second reactants at maximum compression with complete combustion of the evolved gases with the oxidizing component of the working fluid to enter normal operation. The controller functions just described are readily attained by known microprocessor methods. The injectors for the first and second reactants preferably are of the common rail type wherein the reactants are under a pressure exceeding maximum cylinder pressure and injection timing is determined by the valves 71 and 73 in response to the solenoid 74 or other mechanical, hydraulic, or pneumatic operator responsive to the controller.

Figure 4:
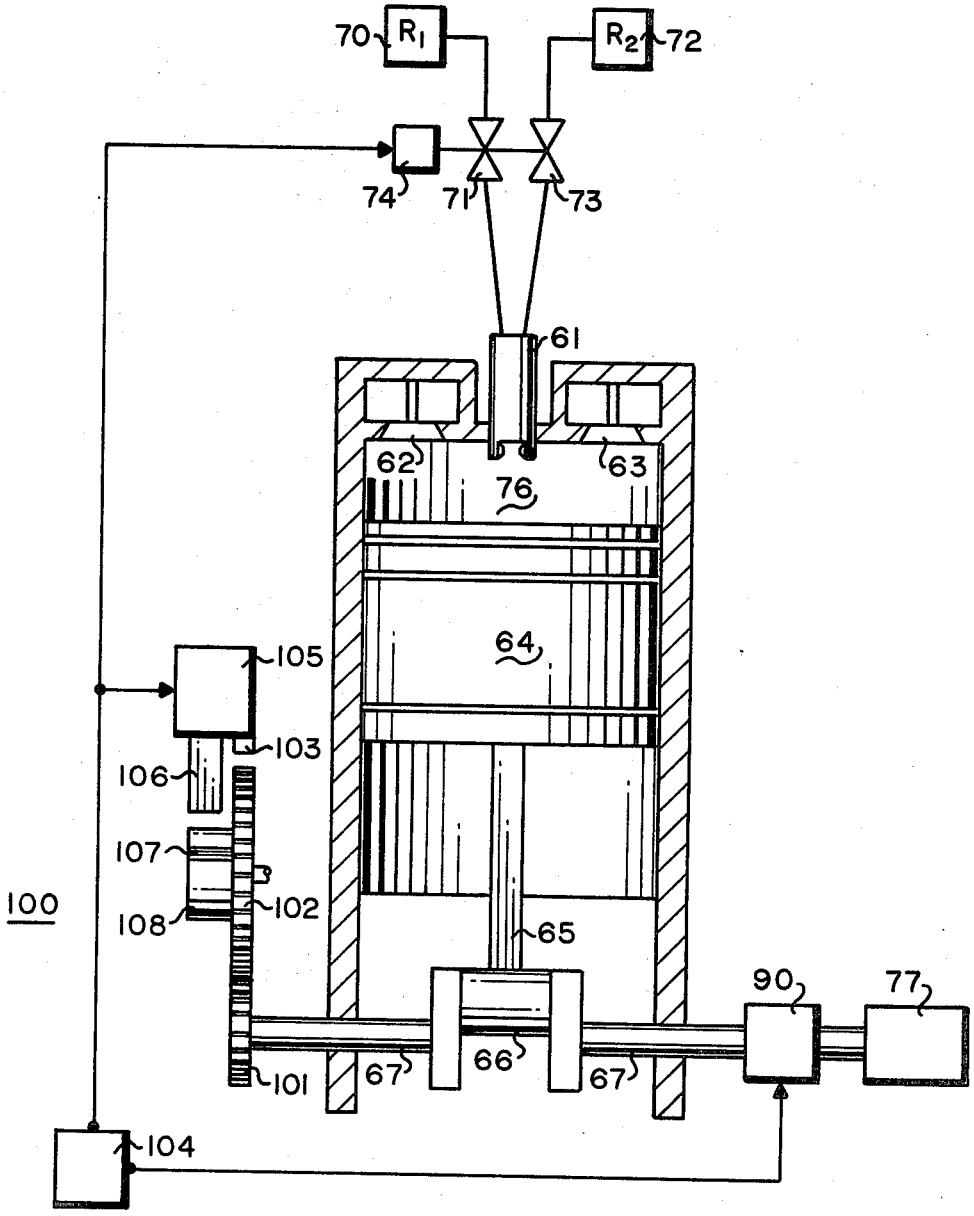
FIG. 4 is a diagrammatic drawing partly in section showing a four stroke cycle internal combustion engine having a mechanical means for stopping the engine in an expansion phase as it is slowing to a stop where it is held until said reactants are injected for starting according to the invention.

FIG. 4 shows a system and process for stopping an engine substantially in an expansion phase where it remains for restarting by injecting reactants having negligible activation energy into a combustion chamber according to the invention. The process comprises mechanically stopping a slowing engine as it is entering an expansion phase which process is illustrated by engine phase retaining assembly 100 and a four stroke cycle piston engine.

The engine phase retaining assembly 100 comprises drive gear 101 connected to crank 67, a 2:1 reduction gear 102 to provide a single rotation for one engine cycle, an RPM sensor 103 such as a magnetic detector sensing passage of gear teeth, an accelerator sensor 104 responsive to accelerator setpoint, and a solenoid control 105 which engages and releases locking bar 106 in slot 107 of locking disk 108. The engine is similar to the engine described with reference to FIG. 3.

When accelerator sensor 104 senses release of the accelerator, it releases solenoid 74 to stop injection of the reactants into combustion chamber 76, disengages load 77 through clutch 90, and enables solenoid control 105. The solenoid control 105 receives a reduction gear RPM signal from RPM sensor 103 and releases the locking bar 106 at a predetermined slow gear speed. The locking bar engages slot 107 as the slot passes the locking bar to stop the engine in an expansion phase where it remains until restarting.

When accelerator sensor 104 senses accelerator depression for engine operation, it enables solenoid control 105 to withdraw the locking bar 106 from slot 107 and actuates solenoid 74 to inject reactants into the combustion chamber 76 to evolve a hot gas which expands against piston 64 to develop a power stroke of sufficient magnitude to drive the engine into the next expansion phase where the reactants are injected into a compressed working fluid for normal operation. At a predetermined RPM, accelerator sensor 104 enables clutch 90 to engage the load.

Other means such as friction brakes may also be used to stop a slowing engine in an expansion phase. A piston in a cylinder is a representative movable member communicating with a combustion chamber and alternative movable members include rotors in rotary type internal combustion engines.

I claim:

1. A system for starting an internal combustion engine, comprising:

an internal combustion engine having at least one combustion chamber which communicates with a movable member, means for attaining an expansion phase of at least one of the movable members, means for retaining the expansion phase until the engine is to be started whereby the combustion chamber pressure and temperature may approach ambient levels, a first reactant and reservoir therefor and a second reactant and reservoir therefor, said reservoirs communicating with the combustion chamber, said first and second reactants reacting with negligible activation energy and evolving a gas whereby the gas is evolved and heated upon contact of the first and second reactants, and means for injecting the first and second reactants in a contacting relationship into the combustion chamber which communicates with said movable member in an expansion phase whereby the gas is evolved and heated to expand against the movable member to provide energy for advancing and starting the engine.

2. The system of claim 1 wherein the internal combustion engine is of the free piston type having as the movable members a pair of pistons communicating with a common combustion chamber and the means for attaining the expansion phase comprises means to force the pistons toward each other.

3. The system of claim 1 wherein the means for attaining an expansion phase upon stopping comprises a phase advancing motor which is engagable to the movable member and is disengaged prior to the injection of the reactants.

4. The system of claim 1 wherein the means for attaining an expansion phase comprises an internal combustion engine which has a sufficient plurality of movable members and combustion chambers communicating therewith to assure that at least one of the movable members is in an expansion phase and the system further includes means to select for injection the means for injecting the reactants into the combustion chamber communicating with the movable member in an expansion phase.

5. The system of claim 1 wherein the means for attaining an expansion phase comprises means for stopping the engine in an expansion phase as it is slowing to a stop.

6. The system of claim 5 wherein the means for stopping the engine in an expansion phase comprises means to detect the engine's cycle rate, means to enable an engine stopping means as the cycle rate becomes less than a predetermined level, and means to activate the engine stopping means as the movable member enters an expansion phase whereby the movable member is stopped and retained in the expansion phase for restarting by injection of the reactants.

7. The system of claims 1, 2, 3, 4, 5, or 6 wherein the reactants having negligible activation energy and evolving a gas are an alkali metal and water.

8. A method for starting an internal combustion engine by evolving a gas therein, comprising the steps of:

stopping a movable member of an internal combustion engine in a position which enables motion in response to pressure thereon and maintaining said position for a substantial time before starting the engine whereby any compressed working fluid in a combustion chamber communicating with the movable member is lost from the combustion chamber, closing valve openings communicating with the combustion chamber to prevent rapid loss of compression pressure therefrom, and injecting reactants which have a negligible activation energy and evolve a gas in a contacting relationship into the combustion chamber whereby the gas evolves spontaneously to apply a pressure on the movable member to cause motion thereof which advances the engine to enable normal operation.

9. The method of claim 8 comprising the further steps subsequent to the engine advance of:

closing the valve openings to prevent rapid loss of compression from the combustion chamber, compressing a working fluid in the combustion chamber, injecting the reactants to evolve the gas and to heat the working fluid, whereby pressure applied to the movable member causes motion thereof, and connecting a load to the movable member whereby the motion of the movable member develops power for normal operation of the engine.

10. The method of claim 9 wherein the reactants are an alkali metal and water whereby the evolved gas is hydrogen and the working fluid is air whereby the hydrogen further reacts with oxygen.

11. The method of claims 8 or 10 wherein the step of stopping the movable member in a position which enables motion comprises engaging a phase advancing motor to a crank which advances the movable member into an expansion phase where it remains for the injection of the reactants.

12. The method of claim 8 or 10 wherein the engine has a sufficient plurality of combustion chambers and movable members communicating therewith to assure that at least one of the movable members is in the position which enables motion and comprising the additional step of selecting the movable member in said position for injecting the reactants into the combustion chamber communicating therewith.

13. The method of claim 8 or 10 wherein the step of stopping the movable member in a position which enables motion comprises the further steps of slowing the engine to a predetermined slow speed and locking the engine in said position as the engine passes therethrough.

* * * * *